US007674301B2

(12) United States Patent
Brown et al.

(10) Patent No.: US 7,674,301 B2
(45) Date of Patent: Mar. 9, 2010

(54) YARN AND FABRIC WITH ZONES OF VARIABLE HEAT SET CHARACTER

(76) Inventors: Robert Saul Brown, 6139 Robin St., Spartanburg, SC (US) 29303; William M Pascoe, 178 Blue Sky Dr., Inman, SC (US) 29349

( * ) Notice: Subject to any disclaimer, the term of this patent is extended or adjusted under 35 U.S.C. 154(b) by 1006 days.

(21) Appl. No.: 11/174,795

(22) Filed: Jul. 5, 2005

(65) Prior Publication Data

US 2007/0006400 A1 Jan. 11, 2007

(51) Int. Cl.
*D06P 5/22* (2006.01)

(52) U.S. Cl. ..... 8/478; 8/481; 8/482; 8/483; 8/484; 8/115; 8/922

(58) Field of Classification Search ..... 8/445, 8/478, 481, 482, 483, 484, 115, 922
See application file for complete search history.

(56) References Cited

U.S. PATENT DOCUMENTS

| | | | | | |
|---|---|---|---|---|---|
| 2,979,883 | A | | 4/1961 | Waltz | 57/140 |
| 4,087,242 | A | * | 5/1978 | Frank et al. | 8/478 |
| 4,112,561 | A | | 9/1978 | Norris et al. | 28/243 |
| 4,152,886 | A | | 5/1979 | Nelson | 57/208 |
| 4,153,660 | A | | 5/1979 | Reese | 264/103 |
| 4,244,171 | A | | 1/1981 | Sasaki et al. | 57/208 |
| 4,404,999 | A | | 9/1983 | Woodall, Jr. et al. | 139/391 |
| 4,704,856 | A | | 11/1987 | Nelson | 57/228 |
| 4,897,989 | A | | 2/1990 | Gray | 57/239 |
| 5,184,381 | A | | 2/1993 | Coons et al. | 28/271 |
| 5,354,342 | A | * | 10/1994 | Jenkins | 8/481 |
| 5,413,832 | A | | 5/1995 | Willey | 428/92 |
| 5,491,858 | A | | 2/1996 | Massotte et al. | 8/151.2 |
| 5,549,957 | A | | 8/1996 | Negola et al. | 428/92 |
| 5,557,953 | A | | 9/1996 | Massotte et al. | 68/205 R |
| 5,594,968 | A | | 1/1997 | Haselwander et al. | 8/149 |
| 5,634,249 | A | | 6/1997 | Ballarati | 28/246 |
| 5,858,290 | A | | 1/1999 | Oh et al. | 264/103 |
| 5,858,885 | A | | 1/1999 | Hamilton et al. | 442/184 |
| 5,983,470 | A | | 11/1999 | Goineau | 28/281 |
| 6,019,799 | A | | 2/2000 | Brown et al. | 8/483 |
| 6,129,879 | A | | 10/2000 | Bersted et al. | 264/211.14 |
| 6,385,827 | B1 | | 5/2002 | Stewart et al. | 28/263 |
| 6,832,419 | B1 | | 12/2004 | Williamson et al. | 28/159 |
| 6,981,394 | B2 | | 1/2006 | Keller | 66/202 |
| 7,086,423 | B2 | | 8/2006 | Keller et al. | 139/21 |
| 2002/0066145 | A1 | * | 6/2002 | Gupta et al. | 8/478 |
| 2003/0064646 | A1 | * | 4/2003 | Brown et al. | 442/189 |
| 2008/0010793 | A1 | * | 1/2008 | Wildeman | 28/100 |

FOREIGN PATENT DOCUMENTS

| | | | |
|---|---|---|---|
| DE | 153712 | * | 1/1982 |
| JP | 53031886 | * | 9/1976 |

OTHER PUBLICATIONS

U.S. Appl. No. 10/883,932 entitled "Yam Having Differentiated Shrinkage Segments and Fabrics Formed Therefrom," filed Jul. 2, 2004 (Milliken File No. 5790) to inventor Michael A. Keller.
U.S. Appl. No. 10/835,773 entitled "Yarn Having Variable Shrinkage Zones," filed Apr. 30, 2004 (Milliken File No. 5767) to inventor Michael A. Keller.
U.S. Appl. No. 10/835,772 entitled "Loop Pile Fabric Having Randomly Arranged Loops of Variable Height," filed Apr. 30, 2004 (Milliken File No. 5764) to inventor Michael A. Keller.
U.S. Appl. No. 10/613,241 entitled "Pile Fabric, and Heat Modified Fiber and Related Manufacturing Process," filed Jul. 3, 2003 (Milliken File No. 5635) to inventor Keller et al.

* cited by examiner

*Primary Examiner*—Lorna M Douyon
*Assistant Examiner*—Amina Khan

(57) ABSTRACT

Yarns and fabrics formed from such yarns incorporating an arrangement of discrete zones of variable heat treat history thereby imparting differential dye affinity and structural character at discrete zones along the yarn length are described. The differential dye affinity permits variable shading along the yarn length when the yarn is subjected to a dye bath. Processes and equipment for manufacturing such yarns are also provided.

9 Claims, 8 Drawing Sheets

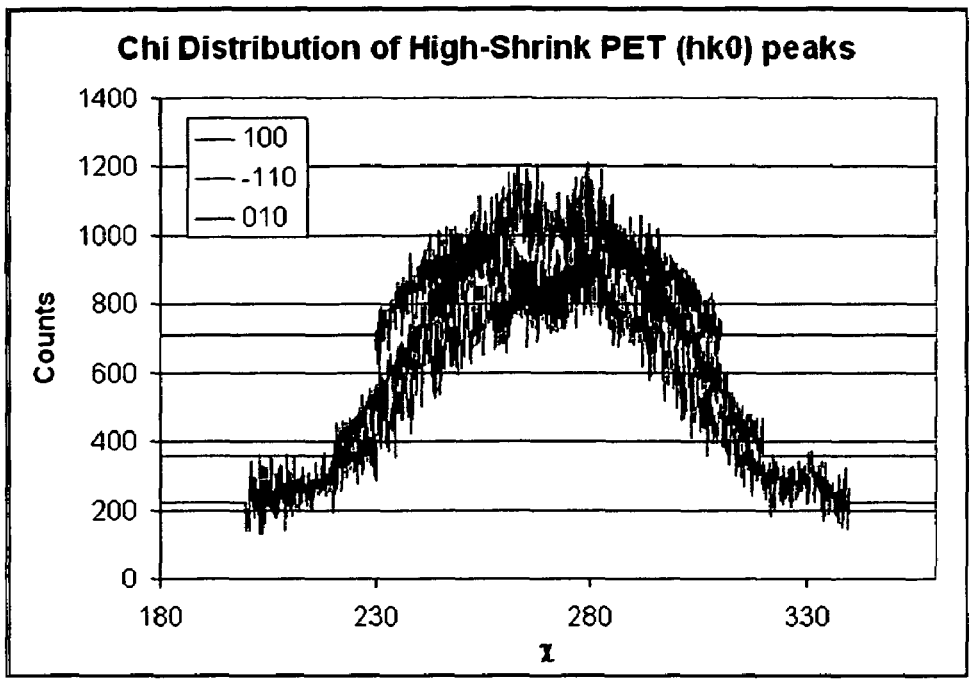
*FIG. —8—*
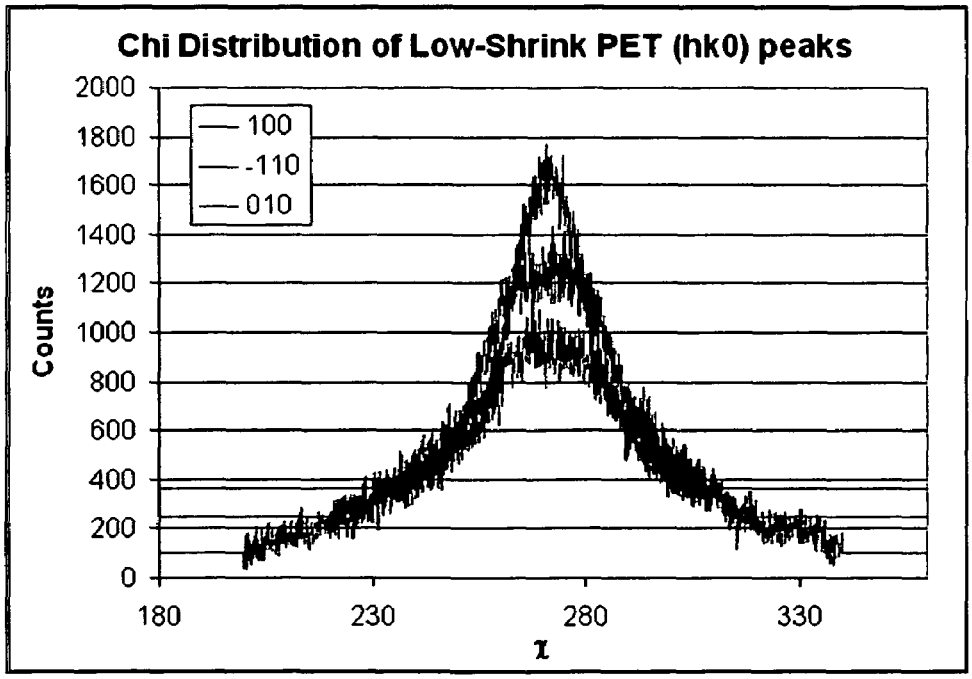
*FIG. —9—*

YARN AND FABRIC WITH ZONES OF VARIABLE HEAT SET CHARACTER

TECHNICAL FIELD

The present invention relates generally to dyeable yarns and to textile structures incorporating such yarns. More specifically, the invention relates to yarns and to a textile material formed from a plurality of such yarns wherein at least a portion of the yarns include controlled length segments of differential character along their length such that dye takeup varies in a controlled manner along the yarn length when exposed to a dye solution. A method and apparatus for introducing the segments of differential character are also provided. All patent documents referenced in this application are hereby incorporated by reference as if fully set forth herein.

BACKGROUND OF THE INVENTION

It is well known to utilize colored yarns within textile materials to impart desired aesthetic characteristics to the textile material. Color is generally imparted to yarns by use of bulk dyeing practices in which a single color is applied to bundles of yarn immersed within a dye bath. Typical dyes as are known to those of skill in the art include disperse dyes, acid dyes and basic dyes. It is also known to heat set yarns by applying a tensioning force to the yarn under elevated temperature conditions. Such heat setting is typically used to impart an enhanced degree of uniformity to the yarn. As will be appreciated, when a yarn treated in accordance with prior practices is subjected to a bulk dyeing operation, the dyed yarn is typically of a substantially uniform solid color. Moreover, such yarns tend to behave in a substantially uniform manner when subjected to post-dyeing heat treatment.

In order to provide variation in color along the length of a yarn it is known to utilize so-called "space-dyed" yarns within pile-forming textile materials such as carpeting to provide a random or pseudo-random pattern within the material. One such carpeting material is illustrated and described in U.S. Pat. No. 5,413,832 to Willey the contents of which are incorporated by reference herein.

Several methods are known for space dyeing of yarns so as to impart segments of various colors along the length of such yarns. One such known method is the so-called "knit-deknit" method in which yarns are knit into a construction across which bands of color are introduced. The knit construction is thereafter unraveled so as to yield the lengths of yarn with substantially random coloration patterns disposed along their length. While useful, the "knit-deknit" process may be difficult to control and may be unduly time consuming and complex to enable efficient and cost effective manufacture of large quantities of material.

In order to address the deficiencies of the "knit-deknit" process, several batch-type and continuous processes have been advocated. Among the batch-type processes (in which a predetermined quantity of yarn is treated at one time), it is known to inject yarn packages with a number of different colored dyes to yield a space-dyed product. However, such batch process may be relatively costly and require more product handling than is desired.

As an alternative to the batch-type processes, several types of continuous space-dyeing processes (in which moving yarns are individually or collectively treated) are also known. One such continuous process is illustrated and described in U.S. Pat. No. 5,594,968 to Haselwander et al. the teachings of which are incorporated by reference herein. In this process yarns are intermittently pressed against dye applicator rolls to impart segments of dye to the yarns in a predetermined order. The yarn is held against the dye applicator rolls by a pattern roll supporting deflecting rods or paddles arranged in spaced relation at the surface of the pattern roll up stream of the dye applicator roll so as to provide a defined period of contact between the yarn and the dye applicator roll as the deflecting elements are pressed against the yarn at locations adjacent to the dye applicator rolls.

U.S. Pat. Nos. 5,491,858 and 5,557,953 to Massotte et al. (incorporated by reference) disclose equipment and procedures for applying dye segments to yarns using spinning disk elements having spaced openings which permit passage of dye droplets towards the yarns when the disk openings and yarns are in opposing relation to one another.

Another continuous process is illustrated and disclosed in U.S. Pat. No. 6,019,799 to Brown et al. the teachings of which are incorporated by reference herein. The process disclosed therein utilizes a substantially direct application of a spray pattern of dye liquor droplets towards a yarn sheet. The dye stream is cycled on and off to apply a desired patterning effect.

In view of the above, the prior art has addressed the desire for color variability along the yarn length by selective dye application at discrete yarn segments. While such practices may provide desirable aesthetic results, they also require a relatively high degree of complexity related to the controlled selective dye application. In particular, multiple dye delivery systems are required in combination with precision application equipment.

SUMMARY OF THE INVENTION

The present invention provides advantages and/or alternatives over the prior art by providing yarns of partially oriented character incorporating an arrangement of discrete zones of variable heat treat history thereby imparting differential dye affinity and structural character at discrete zones along the yarn length. The differential dye affinity permits variable shading along the yarn length when the yarn is subjected to a dye bath. The different zones may also exhibit selective shrinking during post-formation heat setting. Textile materials incorporating such variable segment yarns as well as processes and equipment for manufacturing such yarns are also provided.

BRIEF DESCRIPTION OF THE DRAWINGS

The present invention will now be described by way of example only, with reference to the accompanying drawings which constitute a part of the specification herein and in which:

FIGS. 8 and 9 illustrate X-ray distribution peaks for the high and low shrinkage potential yarn segments respectively.

While the invention is illustrated and will be described in connection with certain potentially preferred embodiments, procedures and practices, it is to be understood that in no event is the invention to be limited to such illustrated and described embodiments, procedures and practices. On the contrary, it is intended that the present invention shall extend to all alternatives and modifications as may embrace the principles of this invention within the true spirit and scope thereof.

DESCRIPTION OF THE PREFERRED EMBODIMENTS

Figure 1:
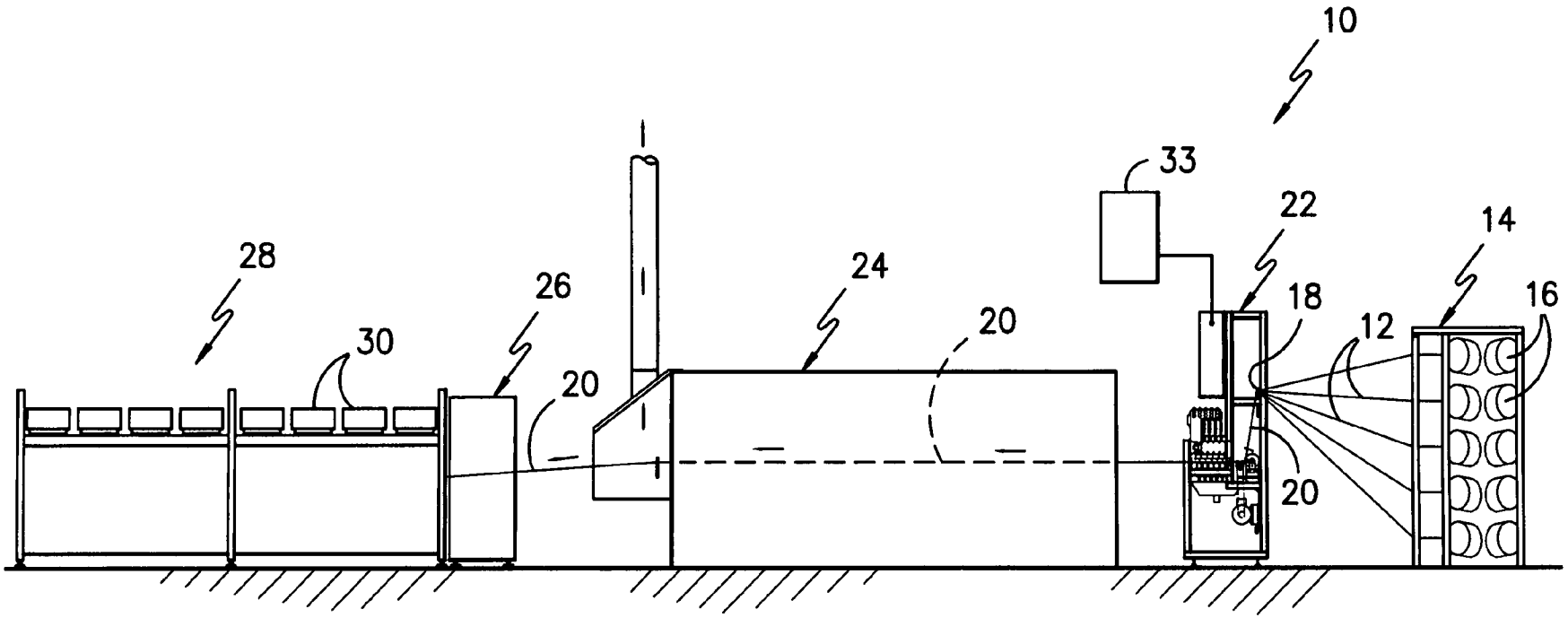
FIG. 1 is a side view of a treatment line for applying variable heat treatment to discrete segments along the length of a yarn sheet.

Reference will now be made to the drawings, wherein to the extent possible like reference numerals are utilized to designate like components throughout the various views. FIG. 1 shows an exemplary treatment line 10 for use in applying a heat sink liquid such as water at discrete segments along a plurality of yarns 12. As illustrated, the treatment line 10 preferably includes a creel 14 which holds a multiplicity of yarn packages 16. Individual yarns 12 from each package 16 are passed through a first comb 18 wherein the yarns 12 are arranged in a substantially uniformly spaced, parallel fashion so that the yarns 12 do not overlap and are properly spaced in side to side relation to form a yarn sheet 20. The yarn sheet 20 passes through a heat sink liquid applicator 22 for controlled intermittent application of heat sink liquid, or water, in a predefined pattern along the yarns 12 in a manner to be described further hereinafter. After water application, the yarn sheet 20 exits the water applicator 22 and passes through a heat treating unit 24 such as a heated tunnel and/or a heater such as a contact heating plate, directional hot air blower or the like as will be well known to those of skill in the art. According to the preferred practice, the heat treating unit 24 is adapted to provide a controlled enthalpy input to the yarn sheet 20 such that the dry zones of the yarns 12 are raised to a substantially uniform temperature through their cross section without completely drying the wet zones or bringing the wet zones just to the point of dryness such that temperature of the wet zones is not increased substantially past the boiling point of the water. If desired, the yarns 12 may be subjected to a degree of drawing or relaxing during the heating process.

In accordance with the preferred practice, the yarns 12 forming the yarn sheet 20 are so called "partially oriented yarns" or POY yarns of multi-filament construction formed from heat shrinkable material such as a thermoplastic. By way of example only and not limitation, exemplary fiber materials may include polyester, polypropylene, nylon and combinations thereof.

Figure 2A:
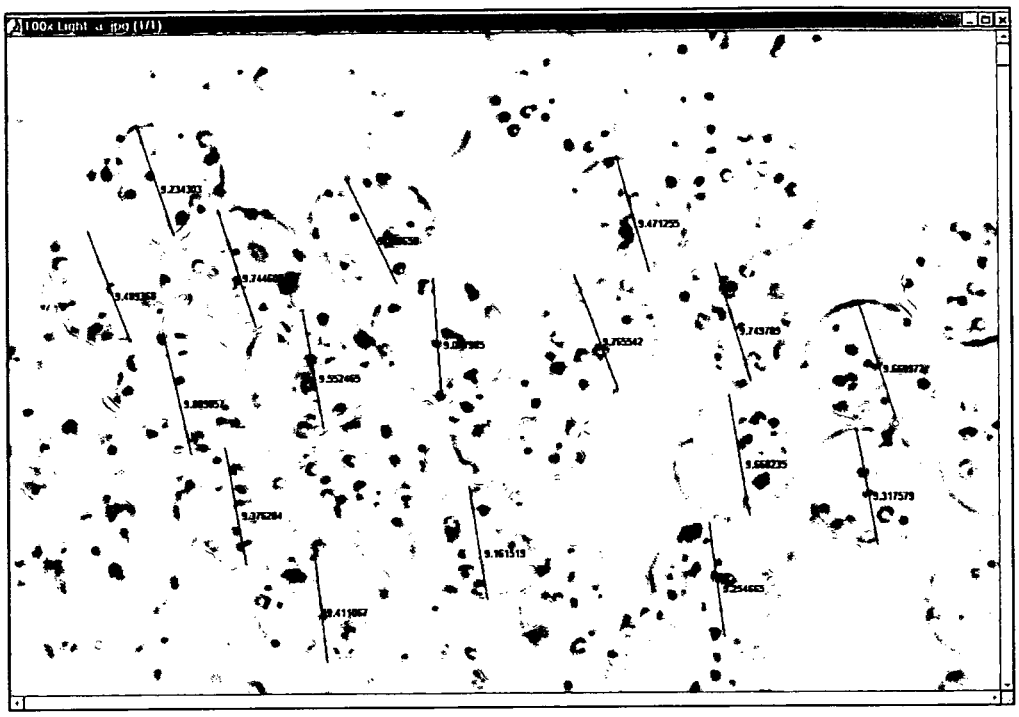
FIG. 2A is a cross-sectional micrograph of yarn filaments in a first portion of a yarn having low dye takeup potential.
Figure 2B:
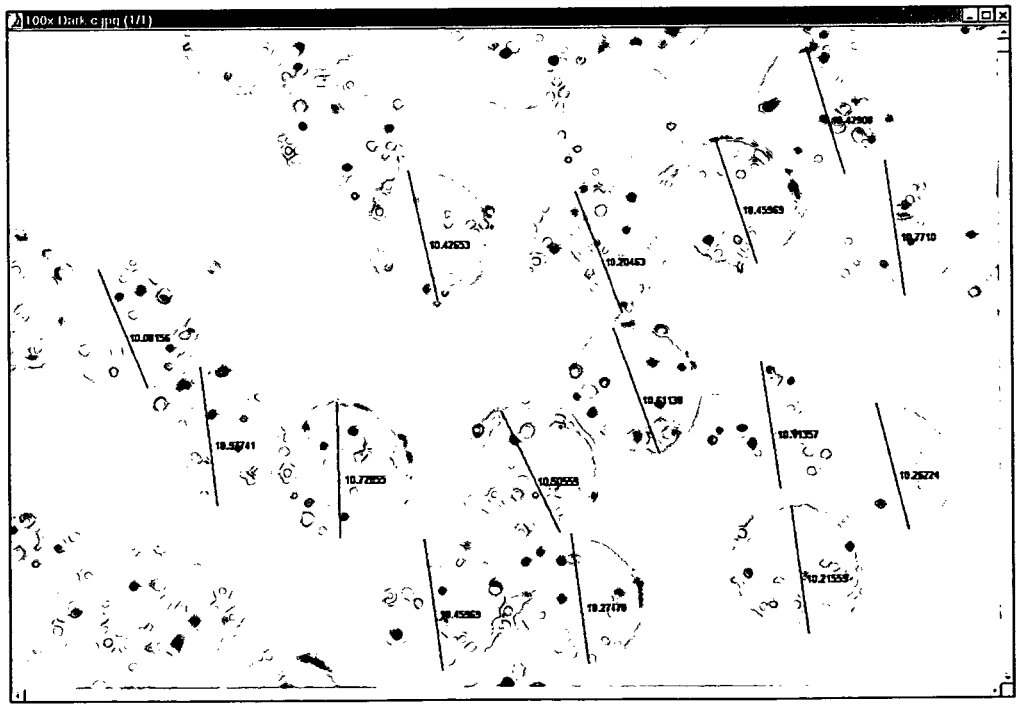
FIG. 2B is a cross-sectional micrograph of yarn filaments in a second portion of the yarn of FIG. 2A having high dye takeup potential.
Figure 3:
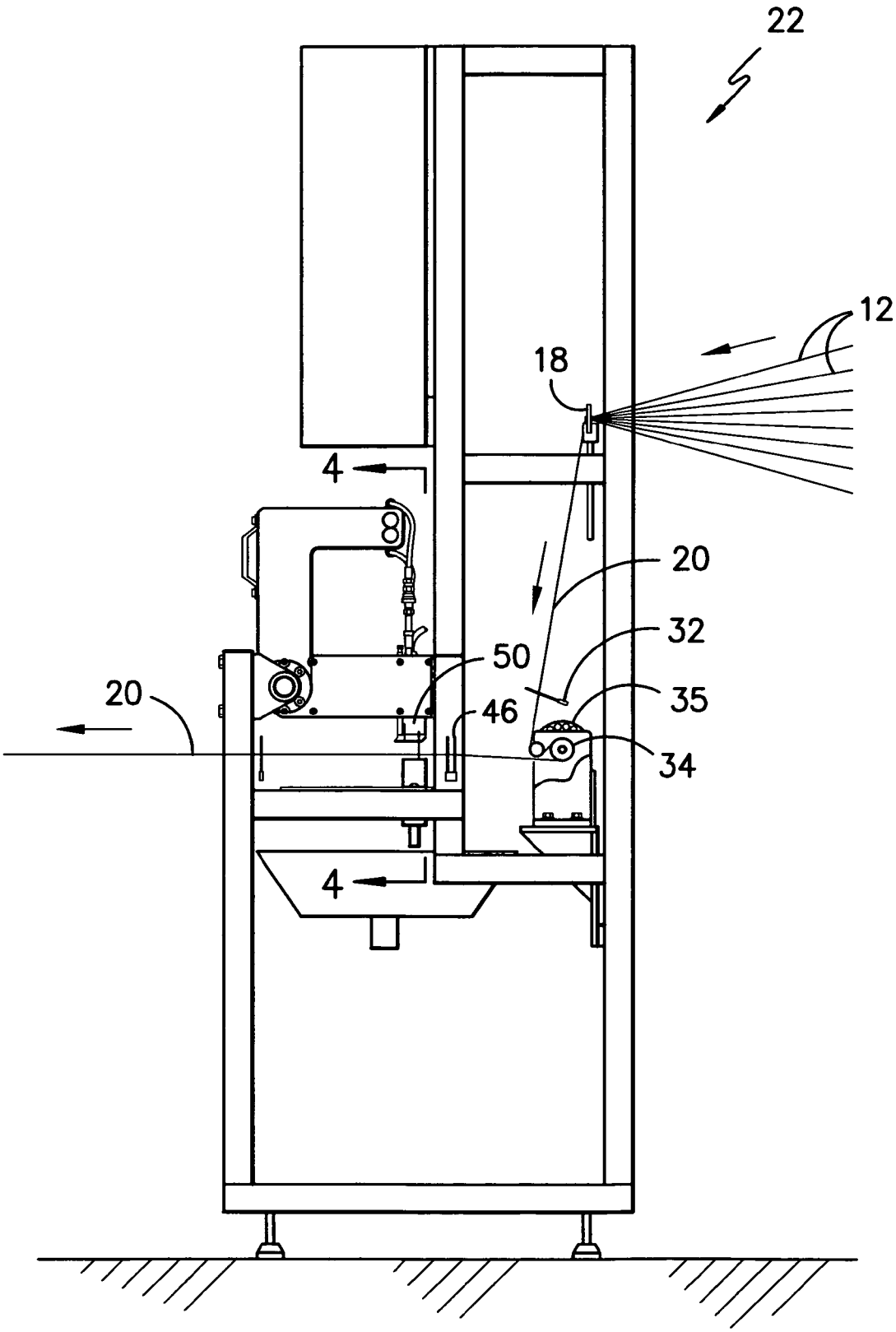
FIG. 3 is a cutaway side view of an application unit within the treatment line for selectively applying water to a yarn.

According to the potentially preferred practice the yarn is conveyed through the heat treating unit 24 at a rate of speed such that the yarn reaches a state of temperature equilibrium in its cross-sectional dimension but not at all segments along its length. In particular, it is preferred that the temperature and yarn speed be set such that the water in the wet segments is at least partially evaporated but the temperature is not raised significantly past the boiling point of the water. In this regard it is to be understood that some portion of the applied water may remain in the yarn following heating. As will be appreciated, during heating the water acts as a heat buffer to limit temperature elevation within the yarn at the wet zones. Conversely, when the dry zones are subjected to the same treatment, the temperature is elevated to substantially higher levels since no buffering force is in place. It has been found that by bringing the wet segments to a point of nearly complete water evaporation, that the dry segments may be heated sufficiently to provide a substantially uniform heat profile in the cross section. Significantly, following heat treatment and any subsequent dyeing and finishing operation, the filaments within the water application zones are characterized by a first substantially uniform cross sectional area across the yarn width. Likewise, following heat treatment and any subsequent dyeing and finishing operation, the filaments within the dry zones are characterized by a second substantially uniform cross sectional area across the yarn width. In this regard, by the term "substantially uniform cross sectional area" it is meant that across the thickness of the yarn within a given yarn segment at least 90% of the filaments have individual cross-sectional areas that are within 10% of the median cross-sectional area for all filaments in the yarn segment. This characteristic of substantially uniform filament area has been confirmed by the examination of photomicrographs of the yarn bundles. By way of illustration only, FIG. 2A is a micrograph of fibers in a segment of a representative POY polyester yarn that was heat treated with water application and thereafter dyed. FIG. 2B is a micrograph of fibers in a segment from the same yarn that was subjected to heat treatment and dyeing without water impingement. As seen, in both segments the individual filament cross-sectional area is substantially uniform across the yarn. Moreover, as will be described further hereinafter, X-ray analysis indicates that the segments subjected to water treatment have differential crystalline character relative to the segments that are not subjected to water impregnation.

According to the illustrated practice, after exiting the heat treating unit 24 the yarn sheet 20 enters a yarn inspection system 26 to detect any breakage of the individual yarns 12. The yarns 12 may then be wound by a winder 28 into packages 30. The packages 30 of yarn may thereafter be formed into a fabric such as by weaving, knitting or the like that is subjected to dyeing and finishing treatments to yield a final textile structure. As indicated, the yarns have a variable crystalline character along their length. Such variable crystalline character is believed to yield variable dye affinity along the length of the yarn. Thus, after dyeing and heat treatment, a final textile construction incorporating the yarn is characterized by variable coloration across its surface.

Turning to FIGS. 3-6, one potentially desirable water application procedure is illustrated. As shown, within the water applicator 22 the yarn sheet 20 passes through a second comb 32 and loops around an indexing roll 34. An encoder 35 linked in communication with the indexing roll 34 monitors the progression of the yarn sheet 20 and communicates such data to an operating computer 33 (FIG. 1) which has been programmed to control the application of water at discrete, predefined locations along the yarns 12 within the yarn sheet 20. The yarn sheet 20 is then passed through a third comb 46 and towards a water stream application station 50 which may apply a stream of water to the yarns 12 in a predefined pattern.

Figure 4:
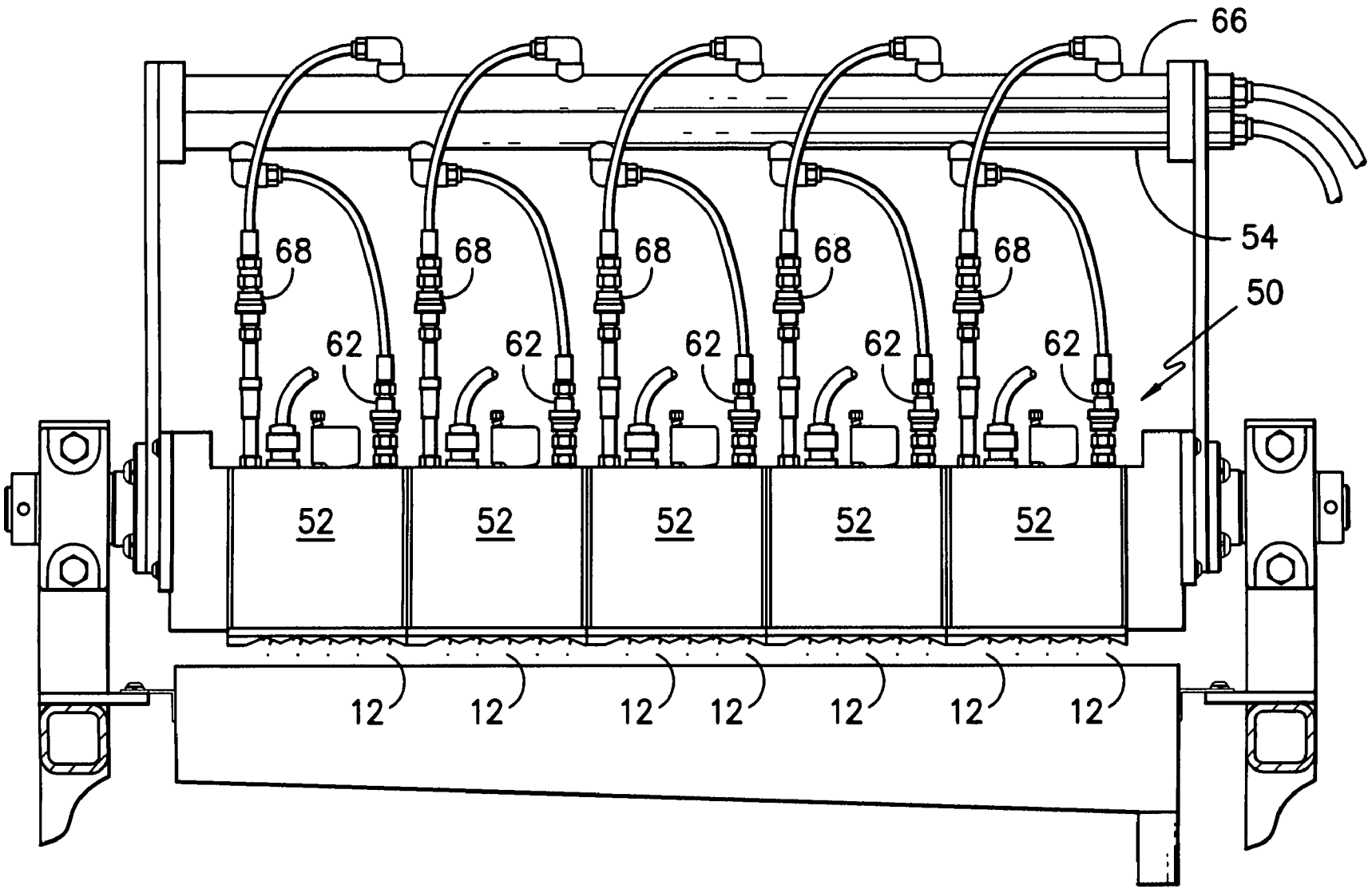
FIG. 4 is a view taken along line 4-4 in FIG. 3 illustrating an arrangement of water application modules in opposing relation to a yarn sheet.

As illustrated in FIG. 4, the water stream application station 50 is disposed substantially transverse to the travel path of the yarns 12 forming the yarn sheet 20. As shown, the water stream application station 50 preferably includes a multiplicity of water stream application modules 52 to apply water streams to a number of opposing yarns 12. According to the illustrated and potentially preferred practice, each of the water stream application modules 52 is preferably substantially identical in configuration and is linked to a common water feed source 54. Of course, one or more modules may be fed by an alternative water feed source if desired.

Figure 5:
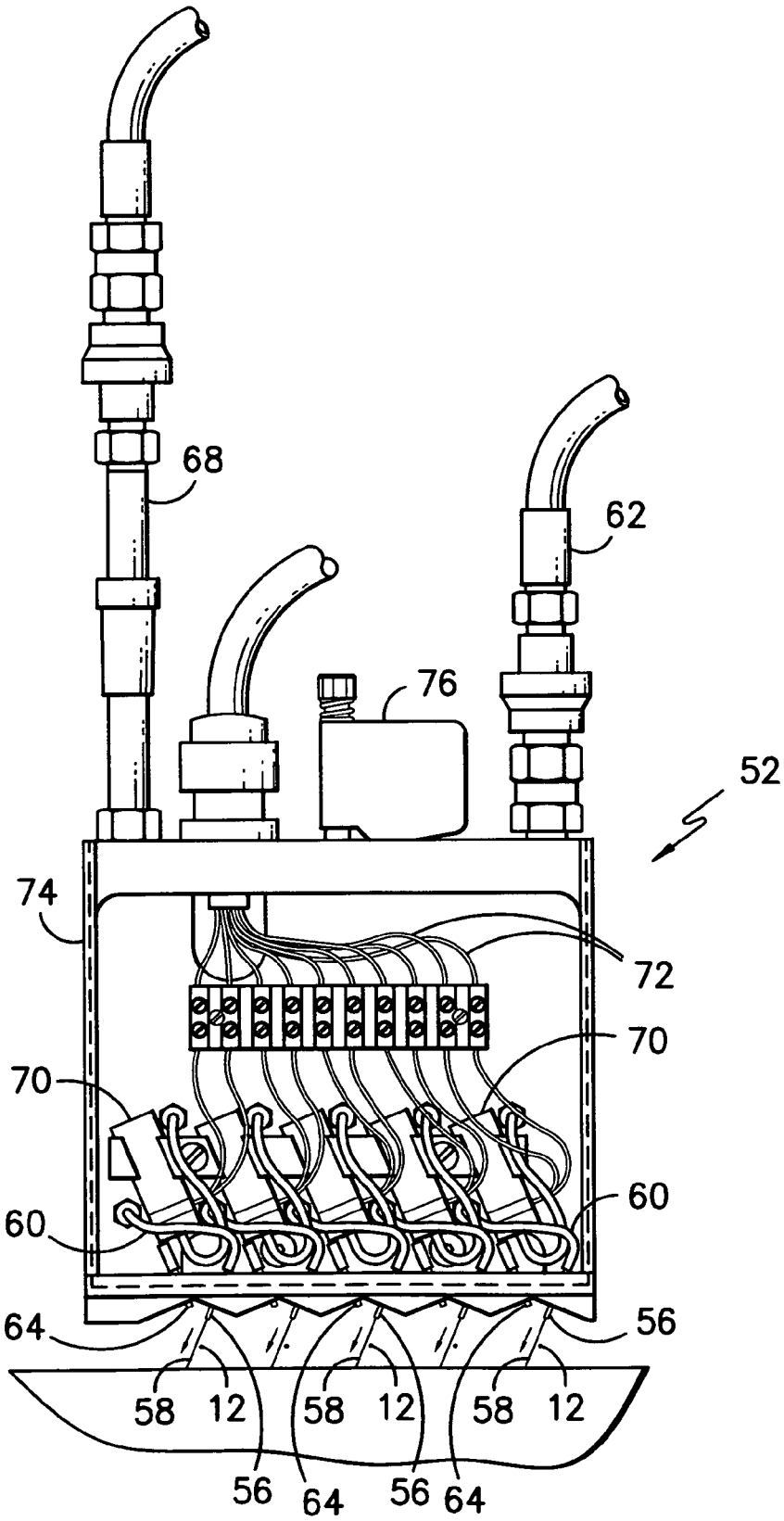
FIG. 5 is a partially cutaway view of a water application module incorporating a multiplicity of water nozzles for application of water streams to a yarn sheet and gas nozzle for projection of interrupting gas jets.
Figure 6:
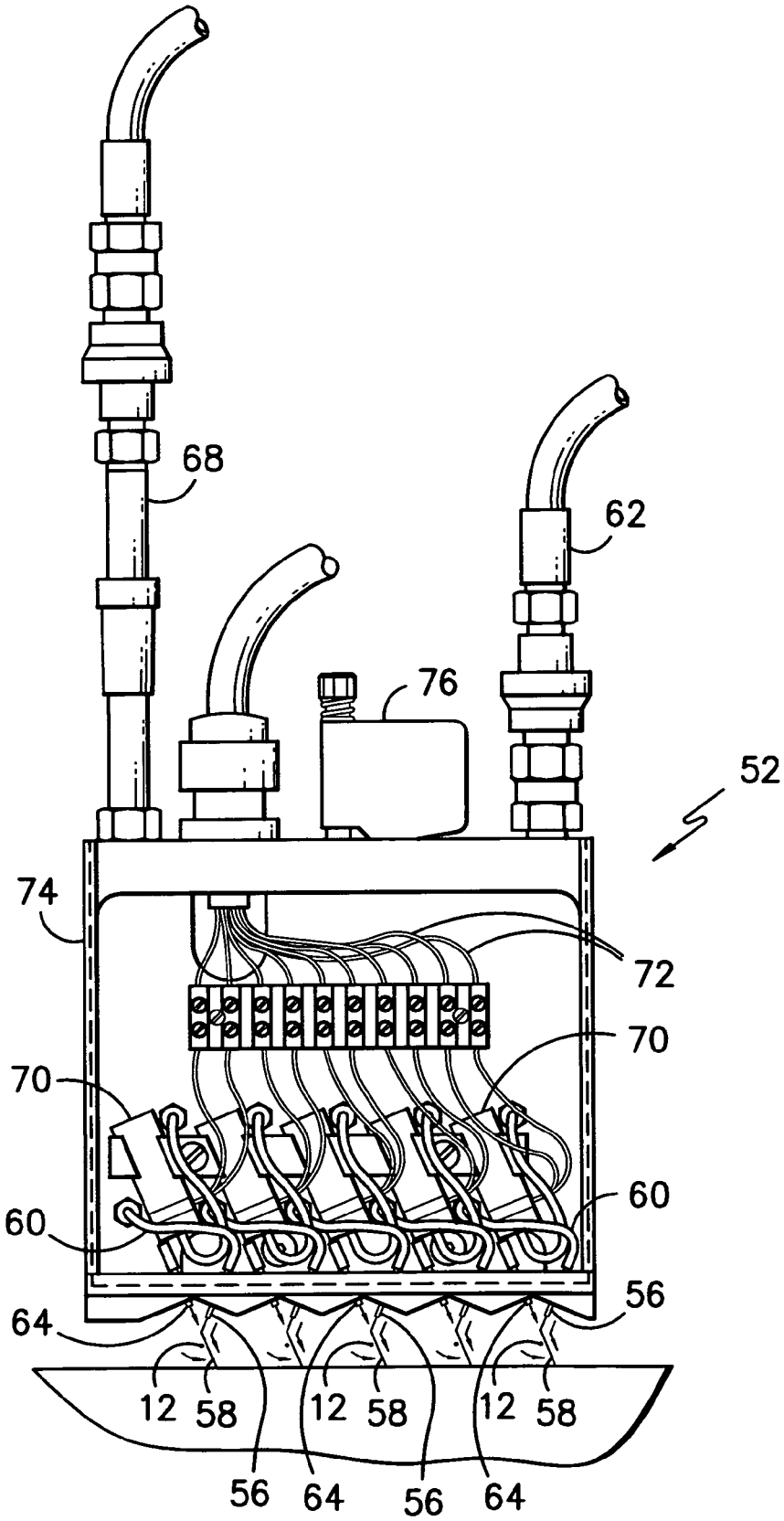
FIG. 6 is a view similar to FIG. 5 upon activation of the interrupting gas jets.
Figure 7:
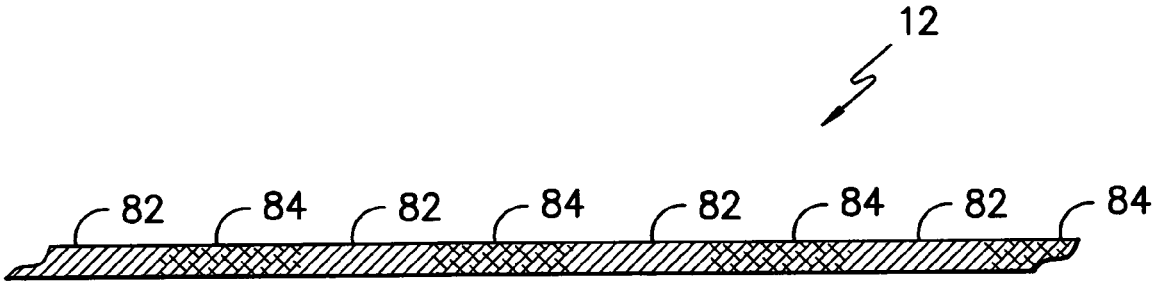
FIG. 7 illustrates an arrangement of wet and dry segments along a yarn as may be applied by the application unit illustrated in FIG. 3.

Referring now simultaneously to FIGS. 5 and 6, one practice for the application of water to discrete segments along individual yarns 12 is illustrated. As shown, the water stream application modules 52 each include a multiplicity of water nozzles 56 projecting in angled relation towards the yarn sheet 20. The water nozzles are arranged so as to discharge a narrow stable water stream 58 to the side of the individual yarns 12 such that under normal conditions there is no interaction between the water stream 58 and the yarns 12. According to the potentially preferred practice, each of the water nozzles 56 has an outer diameter of about 0.065 mm with an inner diameter of about 0.033 mm and is operated at a fluid pressure of about 0.5 psi to about 1.5 psi (about 0.035 to about 0.105 Kg force per square cm). Each of the water nozzles 56 is preferably connected via tubing 60 to the common pressurized water feed source 54 (FIG. 3) by an inlet 62. Thus, each of the water nozzles 56 preferably transmits a water stream 58 of substantially the same character.

In order to apply water to discrete finite length segments of the individual yarns 12, the illustrated water stream application module 52 includes a multiplicity of gas nozzles 64 having an outer diameter of about 0.083 mm with an inner diameter of about 0.049 connected to a pressurized gas source 66 such as instrument quality air or nitrogen at a pressure of about 12 to about 15 psi (about 0.84 to about 1.05 Kg force per square cm) via an air line 68. Gas flow through the nozzles 64 is cycled on and off in a predetermined programmed manner by fast acting valves 70 such as valve model LFAX0512000BA which is believed to be available from the Lee Company having a place of business in Westbrooke, Conn. USA. The valves 70 are preferably controlled by the operating computer 33. In this regard, it is contemplated that the valves 70 may be operated either in unison or individually via control signals carried by transmission lines 72 linked to the operating computer 33 or other control device such as a programmable logic controller or the like as may be known to those of skill in the art.

In operation, the water stream application module 52 is preferably enclosed within a box-like frame structure 74. A latch structure 76 may be used to remove a face panel to gain access to the valves 70 and other components within the interior of the water stream application module 52 to facilitate maintenance and adjustment as may be desired.

As best illustrated in FIG. 6, upon opening of one or more of the valves 70, a gas impingement jet is projected through the gas nozzles 64 and into contact with the water stream 58. As shown, the jet exiting the gas nozzles 64 intercepts the water stream 58 at a position above the plane of the yarn sheet 20 thereby deflecting the stream 58 away from its normal path on one side of an opposing yarn 12 as shown in FIG. 4 and into an alternative deflected path adjacent the opposite side of the same yarn 12 as illustrated in FIG. 5. During this transition, the water stream 58 is caused to sweep across the adjacent yarn 12 in the direction indicated by the arrows in FIG. 5 until the lower portion of the water stream 58 is in general alignment with the gas nozzles 64 causing the deflection. As will be appreciated, during the deflection process, the water stream 58 applies a short band of water across the yarns 12. Likewise, when the flow of impinging gas is terminated from the gas nozzles 64, the water stream 58 resumes its normal flow path as shown in FIG. 4. During this recovery, another short segment of water is again applied across the yarns 12. The intermittent activation and deactivation of the valves 70 provides for short disperse spots of water with lengths as short as about 1 mm or less along the length of the yarns 12. By simply repeating the process in rapid succession, water may be applied along yarns segments of virtually any length as may be desired. Thus, virtually any combination of wet and dry segments of various lengths may be established along the length of the yarns 12. By way of example only, and not limitation, an arrangement of wet segments as may be applied along a yarn 12 within the water applicator 22 is shown in FIG. 6. As illustrated, the yarn 12 includes discrete length segments 82 designating dry zones and 84 designating wet zones. Of course, any arrangement of lengths may be applied.

As previously indicated, when the yarn 12 with selectively applied wet segments is supplied to the heat treating unit, the wet zones undergo a differential heat treatment relative to the dry zones. In particular, the dry zones may be heat soaked to a higher substantially uniform temperature than the wet zones. Such differential heat treatment has been found to yield substantial micro-structural differences in the zones along the length of the yarn.

It has been found that after heat treatment (such as occurs in fabric finishing) segments of the same yarn treated with water according to the procedures as previously described are characterized by substantially different levels of crystalline orientation than the dry sections as measured by wide angle x-ray diffraction. In order to characterize the molecular structure of the two different types of domains in a finished construction, water treated partially oriented PET polyester yarn was circularly knitted into a sock, dyed, and finished. The finished sock exhibited two distinct regions. In particular, the yarn in the sock had light colored, high shrinkage sections corresponding to zones where water was previously applied and dark colored, low shrinkage sections corresponding to zones where water was not applied. Samples of each type of region were removed from the construction and mounted for x-ray measurement. Wide-angle diffraction patterns were generated via exposure to x-rays generated with a rotating copper anode source having a primary wavelength of 1.5418 Å. Patterns were recorded using a general area detector system offset to an angle of 2=16.5° and set 15 cm from the sample position. Samples were oriented in the beam such that the fiber axis was vertical. Exposures of 90 minutes were used to generate patterns, and a background pattern acquired over an empty position on the sample holder was subtracted from the resulting data.

Qualitatively, there are two main differences between the patterns. First, the maximum intensities in the low-shrink pattern are greater than in the high-shrink pattern. Such intensity differences are consistent with differences in the microstructure of the two domains. The second clearly noticeable difference in the two patterns is that the crystal plane reflections (the broad peaks) in the high-shrink sample have a greater azimuthal spread than those in the low-shrink sample. Care was taken during sample preparation to equally parallelize the filaments, and a slight tension was applied to maintain good orientation during handling and measurement. Accordingly, the observed azimuthal spread reflects a difference in the angular distribution of crystallites between the two samples.

This difference can be quantified in terms of the Herman orientation function:

$$f_c = \frac{3\langle\cos^2\sigma\rangle - 1}{2}. \quad (1)$$

The Herman orientation function is a measure of the orientation of PET chains within fiber crystallites with respect to the fiber axis direction. It assumes values ranging from +1 (perfectly oriented parallel to the axis) to 0 (perfectly random) to −½ (perfectly oriented perpendicularly). For cylindrically symmetric (on average) fibers, the distributional average of the square cosine term is given by:

$$\langle\cos^2\chi\rangle = \frac{\int_0^{\pi}\cos^2\chi I_P(\chi)\sin\chi\, d\chi}{\int_0^{\pi} I_P(\chi)\sin\chi\, d\chi}. \quad (2)$$

Where $I_P(\chi)$ is the angular distribution of a directional vector P (in this case, the PET chain direction) as measured with respect to a reference direction, in this case the fiber axis.

In PET there does not exist a crystalline reflection in the direction of the PET chains. So to determine the Herman orientation function for PET chains, the following geometric relationship is utilized:

$$\langle\cos^2\sigma\rangle = 1 - 0.8786\langle\cos^2\chi_{(010)}\rangle - 0.7733\langle\cos^2\chi_{(110)}\rangle - 0.3481\langle\cos^2\chi_{(100)}\rangle, \quad (3)$$

where σ is the relative angle of the PET chain axis, and $\chi_{(hk0)}$ are the relatives angles of the (hk0) crystalline reflections. The $\langle\cos^2\chi_{(hk0)}\rangle$ terms can be numerically computed by extracting the $I_{(hk0)}(\chi)$ distributions from the measured diffraction patterns.

Angular distributions were computed by integrating the pattern signals over a 0.7° range of 2□ values centered on the following positions: 17.65° for the (010) reflection, 22.75° for the (110) reflection, and 25.35° for the (100) reflection (FIG. 6). Distributions of x-ray peaks for the high shrink and low shrink yarn segments (used for purposes of integration) are shown in FIGS. 8 and 9 respectively. Because of the limited detector area, distributions were extrapolated out to the full 180° range by assuming the signal at high angles was due solely to amorphous scattering. This amorphous baseline was subtracted from the distributions before numerical integration.

Results from the numerical determination of the Herman orientation function are shown in Table I. As shown, the low-shrink yarn sample does possess a measurably higher level of orientation.

TABLE I

| | High Shrink | Low Shrink |
|---|---|---|
| <cos^2(θ100)> | 0.110 | 0.040 |
| <cos^2(θ110)> | 0.113 | 0.064 |
| <cos^2(θ010)> | 0.139 | 0.138 |
| <cos^2(σ)> | 0.752 | 0.815 |
| Herman fc | 0.628 | 0.722 |

Based on the evaluations carried out it may be seen that the water treated portions along the yarn give rise to the high shrink portions of the yarn. Moreover, upon application of heat treatment these high shrink portions shrink to a greater degree and have a lower level of crystalline orientation (as measured by the Herman Orientation Function) than the low shrink portions. Moreover, the degree of variation in crystalline orientation along the length of the yarns of the present invention is substantially greater than variations in standard yarns. In this regard it is contemplated that the level of crystalline orientation of the low shrink portions of the yarn as measured by the Herman Orientation Function will on average be at least 5% greater (and more preferably at least 10% greater) than the level of crystalline orientation of the water treated high shrink portions.

Figure 10:
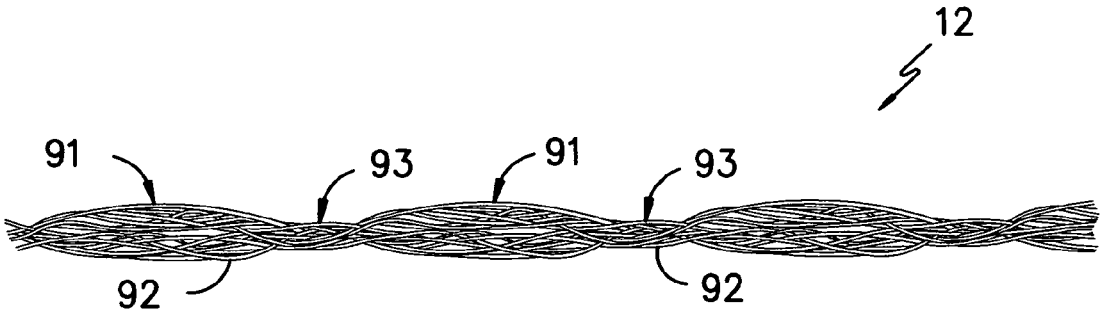
FIG. 10 is a representative illustration of an exemplary POY yarn.

Referring to FIG. 10, a representative illustration is provided of a partially oriented yarn (POY) 12 such as may be treated according to the practice described above. As illustrated, the yarn 12 of partially oriented construction is characterized by loose zones 91 in which the individual filaments 92 are disposed in generally aligned loose orientation relative to one another. These loose zones 91 are interspersed by discrete interlace nodes 93 in which the filaments are interlaced in a more compacted relation so as to hold the overall yarn 12 together. Importantly, it has been found that the protection afforded by the water in the wet zones in combination with the substantially uniform high temperature heat treatment in the dry zones, allows dye takeup variability characteristics to be imparted along the length of the yarn 12 substantially independent of the presence or absence of the nodes 93. That is, zones of low crystallinity may be selectively and controllably imparted at virtually any location along the yarn including nodes and/or loose zones. Likewise, zones of higher crystallinity may be selectively and controllably imparted at virtually any location along the yarn including nodes and/or loose zones. Accordingly, at least a portion of the lower crystallinity zones along the length of the yarns 12 will include yarn segments substantially remote from interlace nodes within the partially oriented yarn.

The invention may be further understood through reference to the following non-limiting examples.

EXAMPLE 1

A 44 gauge double needle bar warp knit pile fabric was formed. Bars 1 and 6 were threaded with 1/100/34 56t false twist polyester with a runner length of 93 inches. Bars 2 and 5 were threaded with (170) 100/34 56WD warpdrawn polyester with a runner length of 74.10 inches. Bar 3 was threaded with a (225) 172/200 T-56 semi-dull round heatset polyester POY with a runner length of 282.60 inches. Bar 4 was threaded with a 1/70/72 false twist textured polyester with a runner length of 259.10. Prior to fabric formation the Bar 3 yarn was processed at 800 yards per minute through a computer controlled tap water application apparatus as previously described to create a 1 inch wet, 1 inch dry pattern repeat on the yarn followed by non-contact heating at 435 degrees Fahrenheit in an oven having dimensions 30 feet long×25 inches wide. The only applied tension is from a 4 gram weight creel tension in the creel and the pull of the take-up winder at the end of the machine corresponding to a draw ratio of approximately 1.30. The fabric was formed in a typical sandwich structure with 35.00 courses per inch and a 4.50 mm gap. The knitting was performed with a 2 needle float to minimize streakiness. The sandwich structure was slit using a slit gap of 125.0 and a slit draw of 7.2 to yield a pile fabric with a 0.080 inch pile height, 35.00 courses per inch at the exit, 24.00 wales per inch at the exit and an exit width of 68.50 inches. The slit fabric was thereafter Greige brush heatset using one brush at a speed of 8 yards per minute. The temperature was 300 degrees Fahrenheit with a dwell time of 2 minutes. At the exit of the heatset process the fabric had 33.00 courses per inch, 24.50 wales per inch and a width of 63.50. The fabric may be tensioned during heatsetting to increase or decrease the number of courses per inch as desired. Following heatsetting the fabric was jet dyed at 280 degrees Fahrenheit with a 20 minute hold and 2 degree per minute rate of rise. The dyed fabric was thereafter wet pad tenter dried at 300 degrees Fahrenheit at 20 yards per minute with drying time of approximately 1 minute. The resultant fabric exhibited a high luster sparkling pile caused by variable dye pickup with good coverage and soft hand.

EXAMPLE 2

A 40 gauge single needle bar nap knit fabric was formed using 1520 ends warped on 70 inch section beams. The bar 1 yarn was a (225) 172/200 T-56 semi-dull round heatset polyester POY with a runner length of 128.00 inches. The bar 2 yarn was a 1/140/200 56T false twist textured polyester with a runner length of 130.00 inches. The bar 3 yarn was a 1/150/36 semi-dull round false twist polyester with a runner length of 85.00 inches. The fabric was formed with 27.80 coarses per inch using a 2 needle float to minimize streakiness. Prior to fabric formation the Bar 1 yarn was processed at 800 yards per minute through a computer controlled tap water application apparatus to create a 1 inch wet, 1 inch dry pattern repeat on the yarn followed by non-contact heating at 435 degrees Fahrenheit in an oven having dimensions 30 feet long×25 inches wide. The only applied tension is from a 4 gram weight creel tension in the creel and the pull of the take-up winder at the end of the machine corresponding to a draw ratio of approximately 1.30. The formed fabric was napped at 16 meters per minute and thereafter jet dyed at 280 degrees Fahrenheit with a 20 minute hold and 2 degree per minute rate of rise. The dyed fabric was thereafter wet pad tenter dried at 300 degrees Fahrenheit at 20 yards per minute at 63.50 inch width. The resultant fabric has a flannel appearance from the tonal dyeing caused by variable dye pickup.

EXAMPLE 3

A (255) 196/68 T-56 semi-dull round heatset polyester POY yarn was processes through a water application unit as illustrated in FIGS. 3-6 to apply water spots with dry spaces of about 0.25 to about 0.50 inches between the spots. This yarn was commingled with a 1/250/100 726 T full dull trilobal false twist textured polyester. This collaged yarn was subsequently inserted as filling in a flat woven jacquard across a 3/150/34 false twist textured polyester warp. The woven fabric was jet dyed at 280 degrees Fahrenheit with a 20 minute hold and wet pad tenter dried at 300 degrees Fahrenheit to yield a high contrast heather with random length highlights from variable dye uptake.

It is to be understood that the detailed description as well as the specific examples presented herein are intended to be illustrative and explanatory only. Thus, while the invention has been described in relation to potentially preferred embodiments, constructions, and procedures, the invention is in no event to be limited thereto. Rather, it is contemplated that modifications and variations embodying the principles of the invention will no doubt occur to those of ordinary skill in the art. It is therefore contemplated and intended that the present invention shall extend to all such modifications and variations as may incorporate the broad aspects of the invention within the true spirit and scope thereof.

What is claimed is:

1. A method of applying variable coloration along the length of a yarn, the method comprising the steps of:

(a) providing an elongate polyester partially oriented yarn structure;

(b) selectively applying a heat sink liquid to discrete segments of the elongate yarn structure to provide an arrangement of wet segments interspersed with substantially dry segments along the length of the elongate yarn structure;

(c) delivering the elongate yarn structure having wet segments interspersed with substantially dry segments to a heat treatment unit;

(d) delivering heating energy to the elongate yarn structure at the heat treatment unit such that the temperature within portions of the dry segments is raised to a substantially uniform elevated first temperature across the yarn structure and such that the temperature within portions of the wet segments is raised to a substantially uniform second temperature below the first temperature, wherein after delivering heating energy to the elongate yarn structure, the dry segments are first segments having a first substantially uniform cross-sectional area and the wet segments are second segments having a second substantially uniform cross-sectional area, wherein the first substantially uniform cross-sectional area and the first segments are characterized by a dye affinity in excess of the second segments is greater than the second substantially uniform cross-sectional area, and wherein the average level of crystalline orientation of first segments as measured by the Herman Orientation Function is at least 5% greater than the average level of crystalline orientation of the second segments; and (e) subsequent step "d" subjecting the elongate yarn structure to a substantially uniform dye treatment.

2. The method as recited in claim 1, wherein the elongate yarn structure is in a fabric during step "e".

3. The method as recited in claim 1, wherein the heat sink liquid comprises water.

4. The method as recited in claim 2, wherein the fabric is a pile fabric.

5. The method as recited in claim 2, wherein the fabric is a warp knit pile fabric.

6. The method as recited in claim 2, wherein the fabric is a double needle bar warp knit pile fabric.

7. The method as recited in claim 2, wherein the fabric is a single needle bar warp knit pile fabric.

8. The method as recited in claim 2, wherein the fabric is a woven fabric.

9. The method as recited in claim 1, wherein the yarn is a multi-filament polyester partially oriented yarn.

* * * * *